US005893341A

United States Patent [19]

Cox

[11] Patent Number: 5,893,341

[45] Date of Patent: Apr. 13, 1999

[54] MOBILE POOL HEATING APPARATUS

[76] Inventor: Emery E. Cox, 13560 SW. 77th Ct., Miami, Fla. 33156

[21] Appl. No.: 08/588,924

[22] Filed: Jan. 19, 1996

[51] Int. Cl.[6] ..... F22B 5/00

[52] U.S. Cl. ..... 122/13.2; 126/350 R; 122/DIG. 10

[58] Field of Search ..... 126/350 R, 361, 126/362, 350 D; 122/DIG. 10, 13.2, 356, 250 R, 265

[56] References Cited

U.S. PATENT DOCUMENTS

| | | | |
|---|---|---|---|
| 1,377,803 | 5/1921 | Bush | 126/350 R |
| 1,947,594 | 2/1934 | Heijkenskjold | 210/11 |
| 1,949,471 | 3/1934 | Hildebrand et al. | 122/DIG. 10 |
| 2,410,900 | 11/1946 | Radbill | 122/DIG. 10 |
| 2,626,754 | 1/1953 | Parker et al. | 122/DIG. 10 |
| 2,677,353 | 5/1954 | Sharp | 122/DIG. 10 |
| 3,207,133 | 9/1965 | Anderson | 122/250 |
| 3,837,016 | 9/1974 | Schindler | 4/172.17 |
| 3,905,308 | 9/1975 | Laudato | 105/238 R |
| 4,061,132 | 12/1977 | Ashton et al. | 237/1 R |
| 4,718,130 | 1/1988 | Steinback | 4/499 |
| 4,855,569 | 8/1989 | Wiedemann | 219/306 |
| 5,208,923 | 5/1993 | Stiver | 4/493 |
| 5,287,567 | 2/1994 | Eash | 4/493 |
| 5,524,820 | 6/1996 | Regan | 237/19 |
| 5,606,964 | 3/1997 | Bussman | 126/350 R |

*Primary Examiner*—William Doerrler
*Attorney, Agent, or Firm*—Baker & Daniels

[57] ABSTRACT

A mobile water heating apparatus for rapidly heating large volumes of water, such as swimming pools, hot tubs, etc., at multiple sites includes a water heater, a water pump, and a water circuit comprising flexible conduit for direct coupling between the pool of water to be heated and the mobile water heating apparatus. The mobile water heating apparatus is independent of on-site dedicated facilities, provides rapid remote site service for cold weather or emergency situations, and is fully self contained, including energy source for heat generation and power generation for operating the water heating system equipment.

20 Claims, 2 Drawing Sheets

MOBILE POOL HEATING APPARATUS

BACKGROUND OF THE INVENTION

In general the invention relates to water heating devices and in particular to devices for heating pools of water. Typically, pools of water, such as pools, spas, etc., are heated, if at all, by permanent, site-dedicated heaters. Approximately less than half of all swimming pools have on-site heating capability. Of the existing on-site heaters, many are not functional. Often such heating equipment is inactive for long periods of time and is used sporadically, this can have an adverse effect on equipment working life. When a permanent type heater fails, pool water temperature may fall below an acceptable level and use may be greatly reduced or eliminated.

In many climates, especially warm climates, the expense and maintenance of a permanent type heater may be difficult to justify. However, even in such areas there will be occasions when pool water heating is desired. The need exists for temporary and occasional pool water heating, such as for special events during cold weather or power outages. The pool heaters of the prior art fail to satisfy this need. This need typically arises when permanent type pool heaters fail or where pools do not have water heating capabilities and are rendered unusable due to weather conditions. On-demand pool water would extend the season for pool use.

Further, because the environment associated with swimming pools is generally destructive to ferrous metals and electrical equipment in general, on-site equipment, including water heating equipment, is prone to failure and requires extensive maintenance. A shortcoming of prior art pool heating apparatus is the failure to provide a versatile site-independent, self-contained water heating apparatus having means for mobilization permitting self-transportation from site to site as needed.

SUMMARY OF THE INVENTION

In general, the present invention relates to a mobile water heating apparatus for rapidly heating large volumes of water, such as swimming pools, hot tubs, etc., at multiple sites in cases of cold weather, equipment failure, or for special events. In particular, the mobile water heating system of the present invention includes a water heater, a water pump, a self-propelled support structure, and a water circuit including conduit, preferably flexible, for connecting the mobile water heating system to the pool of water to be heated. The mobile water heating apparatus is independent of on-site dedicated facilities and may be directly coupled to the pool of water to be heated or to an on-site water treatment system. The present mobile water heating apparatus provides on-demand rapid, remote site service for cold weather or emergency situations and is fully self-contained, including heating and power energy source and power generation equipment.

Swimming pools are becoming increasingly popular in all climates and are seasonal, at least to some extent when not heated, in all areas of the continental United States. The present invention provides a convenient pool heating service which pool owners can utilize throughout the year, as needed, without incurring the expense of a permanent pool heater.

In one embodiment, the invention provides a mobile water heating apparatus for use in raising the temperature of pools of water at multiple sites. The mobile water heating apparatus includes a self-contained water heater, a water circulating pump, a water circuit, and a support structure.

The water circuit includes an inlet, which receives pool water, and an outlet, which discharges heated water into a pool. The water circuit couples the water circulating pump with the water heater. The platform supports the water heater, the water circulating pump, and the water circuit and is self-propelled, allowing the mobile water heating system to be independently transported to multiple sites.

In another embodiment, the present invention provides a method for rapidly heating pool water for use with a mobile water heating apparatus having a water heater, a water circulating pump, and a water circuit. The method for rapidly heating pool water consists of the following steps. The mobile water heating apparatus is transported by its own means to the pool of water to be heated. An inlet and an outlet of the water circuit is disposed in the pool water. The water circulating pump circulates the pool water through the water heater and the water circuit. The water heater rapidly heats the pool water and the heated pool water is discharged back into the pool at the outlet of the water circuit.

BRIEF DESCRIPTION OF THE DRAWINGS

The above mentioned and other advantages and objects of this invention, and the manner of attaining them, will become more apparent and the invention itself will be better understood by reference to the following description of embodiments of the invention taken in conjunction with the accompanying drawings, wherein.

Although the drawings represent one embodiment of the invention, the drawings are not necessarily to scale and certain features may be exaggerated or omitted in order to better illustrate and explain the present invention.

DETAILED DESCRIPTION OF THE INVENTION

Figure 1:
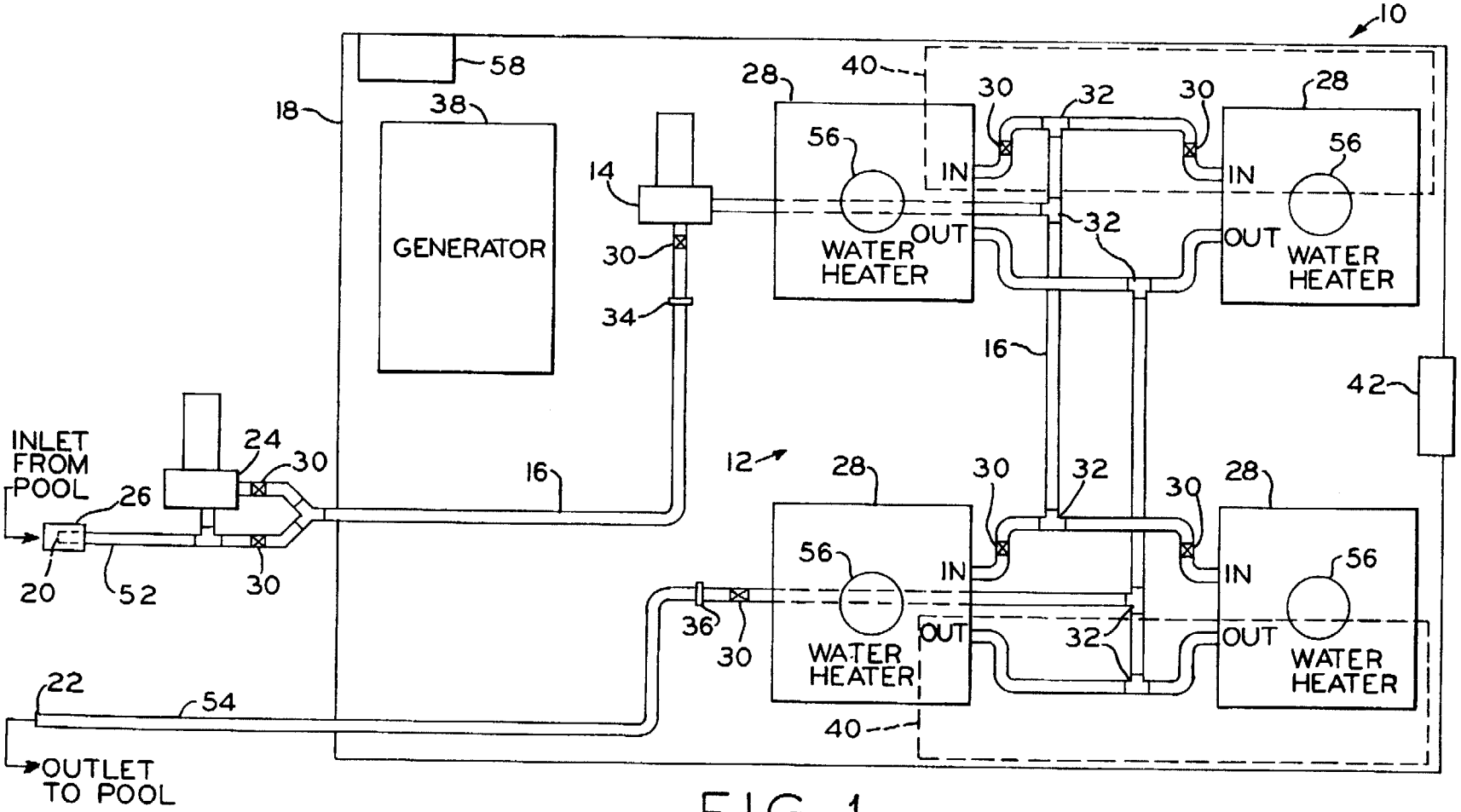
FIG. 1 is a schematic diagram of the mobile water heating apparatus of the present invention.
Figure 2:
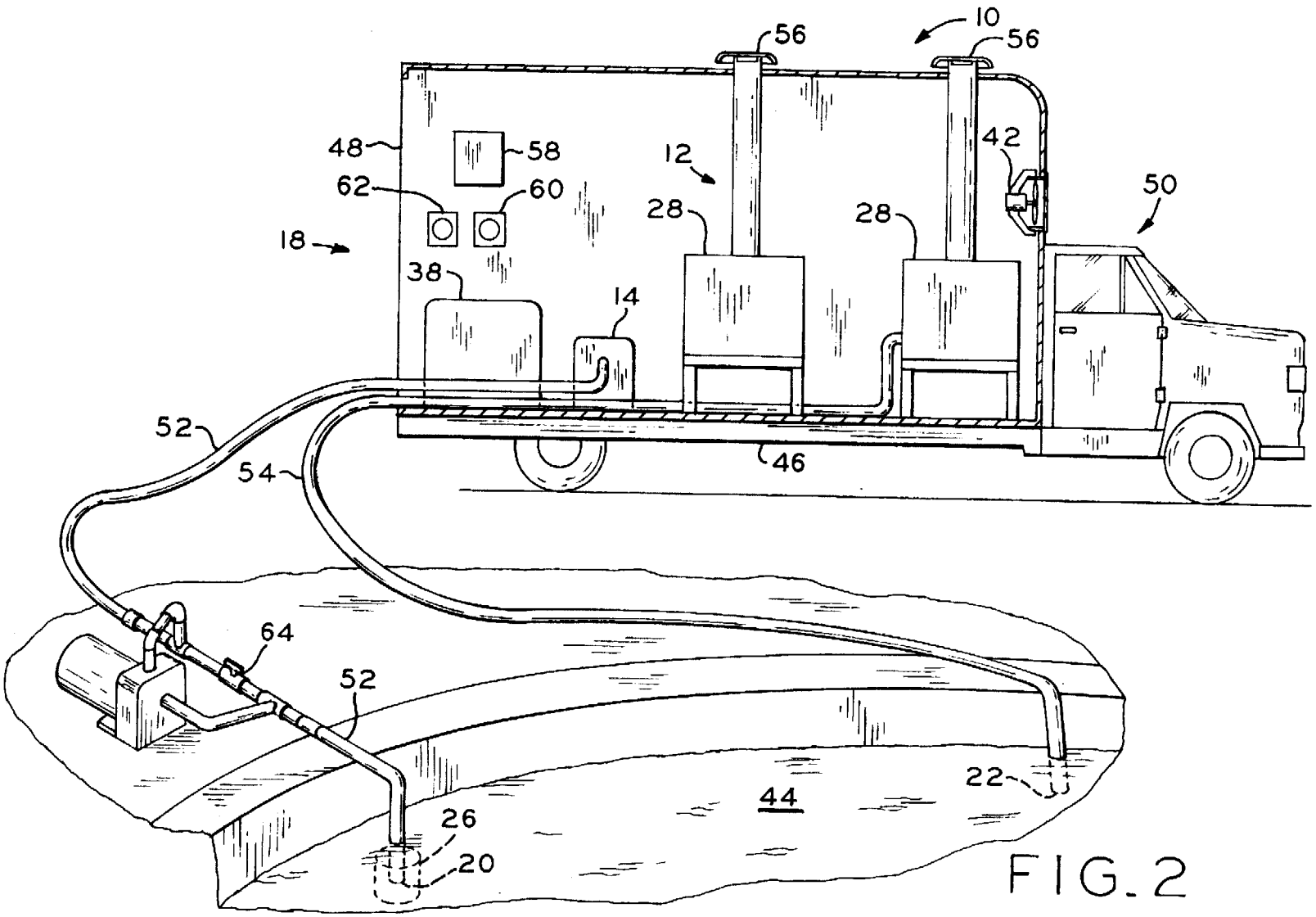
FIG. 2 illustrates the mobile water heating apparatus of FIG. 1 connected to a pool of water to be heated.

Referring to FIGS. 1 and 2, the present invention mobile water heating apparatus 10 is intended for use in raising the temperature of pools of water at remote sites. Mobile water heating apparatus 10 includes self-contained water heater 12, water circulating pump 14, water circuit 16, and self-propelled support structure 18. Water heater 12 is a typical permanent type water heater and is mounted on self-propelled support structure 18 for transportability. This enables a permanent type water heater to be used for remote, multiple site use. Water circuit 16 has an inlet for receiving pool water and an outlet for discharging heated pool water into the pool of water. Water circuit 16 couples water circulating pump 14 with water heater 12. Water pump 14 draws pool water into water circuit 16 at inlet 20 and pumps pool water into and through water heater 12. The heated pool water exits water heater 12 and is discharged into pool 44 at outlet 22 as shown in FIG. 2. In this manner, the water temperature of pool 44 is raised to a desired, user-defined setpoint.

Structure 18, which may include truck bed platform 46 as shown in FIG. 2, supports water heater 12, water circulating pump 14, water circuit 16, and generator 38. Structure 18 is connected to an apparatus which provides sustained, operator controlled mobilization, such as truck 50 or other motorized vehicle. This enables mobile water heating apparatus 10 to be independently transported to multiple sites for effective and immediate response to particularized needs. Air purge pump 24 is disposed in water circuit 16 between inlet 20 and water circulating pump 14. Debris strainer 26 prevents the water heating apparatus from becoming clogged and is disposed in water circuit 16 at inlet 20 in advance of water circulating pump 14. As shown, inlet 20 is directly coupled to pool 44. In the alternative, inlet 20 may be coupled to a permanent on-site water heating/circulating apparatus (not shown).

As shown in FIG. 1, water heater 12 of the present invention consists of multiple water heaters 28, four of which are shown. Water circuit 16 interconnects water heaters 28 in either a serial or parallel manner. Water heaters 12 are shown in FIG. 1 piped in a parallel arrangement with valves 30 provided to enable, disable, or divert the flow of pool water circulated through water circuit 16 to water heaters 28. Although shown piped in a parallel arrangement, water heaters 28 may be piped in a serial manner. Valves 30 may include ball-type check valves disposed in water circuit 16 to permit unidirectional water flow through water circuit 16. Couplings 32 are placed in water circuit 16 for interconnecting the water heaters. Disconnect coupling 34 is disposed in water circuit 16 between water circulating pump 14 and inlet 20 and disconnect coupling 36 is disposed in the water circuit between outlet 22 and water heater 12. Water circuit 16 may at least partially consist of flexible conduit adapted in part to be removed from structure 18 with inlet 20 and outlet 22 positioned in pool 44.

As contemplated, water heater 12 has a heating capacity of between 500,000 and 5,000,000 BTUs and may consist of a single or multiple permanent type pool water heaters 28. For effective operation, each permanent type water heater 28 has a heating capacity of approximately between 100,000 and 5,000,000 BTUs. The number of heaters 28 and the determination of water heating capacity relates directly to the volume of water to be heated and the rate at which the pool water is to be heated. The water heating apparatus shall generally have sufficient heating capacity to raise approximately 3,800 gallons of pool water 25 degrees F in approximately one hour.

In one embodiment, generator 38 is a gasoline driven device having a gasoline storage tank. During operation, generator 38 converts the stored energy source, gasoline, and produces electricity which is used to power water circulating pump 14, air purge pump 24, water heater 12, exhaust fan 42, and any other electric accessories. Exhaust fan 42 effects heat removal and/or the removal of products of combustion. Electric power is distributed to the electric accessories via breaker panel 58. Electric usage meter 60 monitors generator 38 operation and meter 62 monitors heater operation.

A separate energy source storage tank 40 may be provided for storing a stored energy source for supply to water heater 12 making mobile water heating apparatus 10 self-contained and wholly independent of on-site energy resources. Examples of the types of energy sources which may be stored in energy source storage tank 40 are #2 heating oil, natural gas, petroleum, propane, and butane. In an alternative embodiment, batteries may be utilized in place of or in addition to storage tank 40 to supply electrical power to water heating apparatus 10.

FIG. 2 illustrates mobile water heating apparatus 10, after being self-transported to a desired location, coupled to swimming pool 44. In this embodiment, support structure 18 comprises truck bed platform 46, enclosure or housing 48, and truck 50. In the alternative, heating apparatus 10 may be supported by an open truck bed or by a trailer connectable to truck 50. Inlet hose 52 couples heating apparatus 10 with pool 44. Valve 64 is provided to effect desired pool water flow. Pool water is drawn in through inlet hose 52 by pump 14 as described above.

After being heated, the heated pool water exits water heating apparatus 10 through outlet hose 54 at outlet 22 and is returned to pool 44. Hoses 52 and 54 may be connected to an on-site pool water circulating circuit, such as plumbing in a pool house, rather than directly to the pool. Hoses 52 and 54 may be made of flexible material to facilitate operation by permitting the hoses to be directed around obstacles to reach hard to get to pool locations. Air purge pump 24 and associated valves and couplings may be removed from truck 50 for the purpose of placing such devices closer to pool 44.

A sufficient supply of outside air is communicated inside of housing 48 for proper operation of water heaters 28 via a louver, opening, intake fan, or other such device. Exhaust ports 56 may be provided over each water heater 28 for exhausting products of combustion outside of truck housing 48.

In the preferred embodiment, generator 38 is a gasoline driven Winco High Performance Series Generator, Model No. HPM6000HE/M, capable of generating 5500 continuous watts and rated at 11 Hp, or the equivalent. Primary water circulating pump 14 is an American Machine & Tool Company, Inc. pump rated at 2 Hp, having Model No. 2828-95 Code RM, or the equivalent. Purge pump 24 is an American Machine & Tool Company, Inc. ½ Hp pump, having Model No. 2827-95 Code RM or the equivalent.

Heating apparatus 10 consists of four individual heating units 28, each of which is a Teledyne Laars XL-2 Oil-Fired Pool Heater, Model No. DP-350 having a capacity of 350,000 BTUs per hour and having a heat source of #2 heating oil. Truck 50 is a Ford E350 one ton truck and housing 48 is a Supreme Corp. 14 ft. Iner-City Van (Box). Exhaust fan 42 is a Dayton-Direct Drive two speed ¼ Hp. 115 volt fan. Breaker panel 58 is a Square D 100 Amp breaker panel. Hourly usage meters 60 and 62 are Cramer hour meters or the equivalent. Disconnect couplings 34 and 36 are used in arranging water circuit 16 as desired. Hayward ¹ ½" and 2" PVC valves or the equivalent are used to enable, disable, or divert water flow in circuit 16 as desired. Energy storage tanks 40 are 100 gal. external fuel oil tanks.

According to the present invention, truck 50 is driven to a selected site which contains permanent pool 44. Flexible hoses 52 and 54 are uncoiled from within housing 48 and are placed in pool 44 with inlet 20 and outlet 22 being disposed directly in communication with the pool water. Air purge pump 24 is removed from within housing 48 and placed adjacent pool 44 and purges air from incoming pool water along hose 52. Only after air purge pump 24 has purged air from water circuit 16 will primary water circulating pump 14 be allowed to run. After air is purged from circuit 16, purge pump 24 is deactivated and primary circulating pump 14 is activated. Primary circulating pump 14 draws pool water into hose 52 at inlet 20 and circulates water throughout water circuit 16. The activation and sequencing of air purge pump 24 and primary circulating pump 14 can be accomplished by manual operation or by automatic means. Pool water is circulated through water heaters 28 via water circuit 16.

Water heaters 28 utilize electric resistance heating, oil or gas burners, or equivalent heating apparatus to raise the pool water circulated therethrough according to a predetermined set point. Water heaters 28 may operate according to an internal thermostat or according to a primary thermostat located at the output of heating section 12. The internal thermostats activate the particular heating device in heaters 28 to individually maintain a setpoint. A primary thermostat may activate the heating devices of multiple water heaters 28 in a pre-set sequence or in combination. Once heated, the pool water exits heating section 12 along return hose 54 and is returned to pool 44 at outlet 22. During water heater operation products of combustion are removed from housing 48 at ports 56.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A mobile water heating apparatus for use in raising the temperature of pools of water at multiple sites comprising;

a water heater;

a water circulating pump;

a water circuit having an inlet adapted to receive pool water and an outlet adapted to discharge heated water into the pool of water, said water circuit coupling said water circulating pump with said water heater;

an air purge pump disposed in said water circuit between said inlet and said water circulating pump;

a platform adapted to support said water heater, said water circulating pump, and said water circuit; and means for propelling said platform, whereby said mobile water heating apparatus is independently transportable to multiple sites.

2. In a mobile water heating apparatus having a water heater, a water circulating pump, and a water circuit, a method of rapidly heating pool water at multiple sites consisting of the following steps;

independently transporting the mobile water heating apparatus to the pool of water to be heated and disposing an inlet and an outlet of the water circuit into the pool water;

circulating the pool water through the water heater and the water circuit by means of the water circulating pump and purging air from the water circuit;

rapidly heating the pool water within the mobile water heating apparatus by means of the water heater; and discharging the heated pool water into the pool through the outlet of the water circuit.

3. The mobile water heating apparatus of claim 1, further comprising a debris strainer disposed in said water circuit at said inlet, said inlet in communication with the pool water.

4. The mobile water heating apparatus of claim 1, wherein said water heater comprises a plurality of water heaters, said water circuit interconnecting said plurality of water heaters in one of a serial or parallel manner.

5. The mobile water heating apparatus of claim 4, wherein each of said plurality of water heaters has a heating capacity of approximately between 100,000 and 5,000,000 BTUs.

6. The mobile water heating apparatus of claim 4, further comprising a plurality of valves disposed in said water circuit for at least one of enabling, disabling or diverting water flow through said water circuit and said plurality of water heaters.

7. The mobile water heating apparatus of claim 1, wherein said water heater consists of at least one water heater having a heating capacity of between 200,000 and 5,000,000 BTUs.

8. The mobile water heating apparatus of claim 1, wherein said water circuit comprises flexible conduit adapted to be at least partially removed from said platform and positioned with said inlet and said outlet in communication with the pool of water.

9. The mobile water heating apparatus of claim 1, further comprising an enclosure substantially surrounding said platform and said water heating apparatus.

10. The mobile water heating apparatus of claim 1, further comprises a motorized vehicle which comprises said platform and said propelling means.

11. The mobile water heating apparatus of claim 10, wherein said motorized vehicle is a truck.

12. The mobile water heating apparatus of claim 1, wherein said platform is a trailer removably connected to said means for propelling said platform.

13. The mobile water heating apparatus of claim 1, wherein said water heater has sufficient heating capacity to raise approximately 3,800 gallons of pool water 25 degrees F in approximately one hour.

14. The mobile water heating apparatus of claim 1, further comprising a first disconnect coupling disposed in said water circuit between said water circulating pump and said inlet and a second disconnect coupling disposed in said water circuit between said outlet and said water heater.

15. The mobile water heating apparatus of claim 1, further comprising at least one valve disposed in said water circuit for at least one of enabling, disabling, or diverting water flow.

16. The mobile water heating apparatus of claim 1 further comprising an energy source storage device and means for delivering an energy source to said water heater, said mobile water heating apparatus being wholly independent of on-site energy resources.

17. The mobile water heating apparatus of claim 16, wherein the energy source stored in said energy source storage device is one of a group consisting of #2 heating oil, natural gas, petroleum, propane, and butane.

18. The mobile water heating apparatus of claim 1, further comprising at least one check valve disposed in said water circuit to permit unidirectional water flow through said water circuit.

19. The mobile water heating apparatus of claim 1, further comprising a generator adapted to generate electricity for said circulating pump and said water heater.

20. The mobile water heating apparatus of claim 19, wherein said generator comprises a gasoline tank.

* * * * *